US005593247A

United States Patent [19]

Endres et al.

[11] Patent Number: 5,593,247

[45] Date of Patent: Jan. 14, 1997

[54] PROGRAMMABLE BOAT LIFT CONTROL SYSTEM

[75] Inventors: James A. Endres, Clearwater; Francis J. DiRenzi, Palm Harbor; Gideon Hecht, Seminole, all of Fla.

[73] Assignee: Endcor Inc., Clearwater, Fla.

[21] Appl. No.: 524,868

[22] Filed: Sep. 7, 1995

[51] Int. Cl.[6] ..... E02C 5/00; B63B 21/00; B63B 23/40

[52] U.S. Cl. ..... 405/3; 405/221; 114/44

[58] Field of Search ..... 405/3, 221; 414/4, 414/678; 114/44, 45, 48, 369, 373; 187/298

[56] References Cited

U.S. PATENT DOCUMENTS

| | | | |
|---|---|---|---|
| 2,325,994 | 8/1943 | Zoll . | |
| 3,073,125 | 12/1963 | Pearlson . | |
| 4,430,041 | 2/1984 | Hemingway et al. | 414/787 |
| 4,850,298 | 7/1989 | McGlew | 114/373 |
| 5,011,358 | 4/1991 | Andersen et al. | 414/273 |
| 5,020,463 | 6/1991 | Franklin et al. | 405/3 X |
| 5,184,914 | 2/1993 | Basta | 405/3 |
| 5,226,782 | 7/1993 | Rigling | 414/283 |
| 5,378,082 | 1/1995 | Hiller et al. | 405/3 |
| 5,427,471 | 6/1995 | Godbersen | 405/3 |

*Primary Examiner*—Stephen J. Novosad
*Attorney, Agent, or Firm*—Larson & Larson, P.A.; James E. Larson

[57] ABSTRACT

A boat lift control system may be programmed so that with a push of a button, either remotely or adjacent the system, the lift may lift or lower a boat to a pre-programmed elevation. Plural elevations may be programmed into the system including those corresponding to, for example, low tide, high tide, a loading elevation and a storage elevation. The inventive system also includes a manual override allowing manual operation of the lift to any desired elevation. Upper and lower limit stop mechanisms prevent movements of the lift beyond pre-set upper and lower limits.

18 Claims, 6 Drawing Sheets

PROGRAMMABLE BOAT LIFT CONTROL SYSTEM

BACKGROUND OF THE INVENTION

The present invention relates to a programmable boat lift control system. In the prior art, lifting systems of general utility are known, and it is known to pre-program such systems to allow controlled lifting and lowering to and from desired elevations. However, Applicant is unaware of any such system specifically designed for use in the marine environment for lifting and lowering a boat while permitting accommodation to tidal fluctuations as well as the various boating requirements such as lifting a boat to an elevation permitting loading and unloading, lifting a boat to a storage elevation, and launching the boat regardless of water level.

The following prior art is known to Applicant:

U.S. Pat. No. 4,430,041 to Hemingway et al. discloses a crane and manipulator integration provided in an installation for handling a work piece and including a manipulator and an overhead crane. Hemingway et al. fail to contemplate the environment of intended use of the present invention nor the particular programmable levels thereof.

U.S. Pat. No. 5,011,358 to Andersen et al. discloses a height indicator for a fork lift truck which includes a controller that compares programmed store and retrieve heights for various shelves in a warehouse and the current height of the fork. The present invention differs from the teachings of Andersen et al. as contemplating a programmable boat lift control system that allows the user to push a single button and cause a boat lift to move to a pre-programmed elevation.

U.S. Pat. No. 5,226,782 to Rigling discloses an automatic storage and retrieval system for storing and retrieving items to and from a storage receptacle including a track riding dolly carrying a robotic item handler for inserting and extracting items to and from storage. The present invention differs from the teachings of Rigling as contemplating a programmable boat lift control system designed to allow the user to push a single button and move a boat lift to any one of a plurality of pre-programmed elevations.

SUMMARY OF THE INVENTION

The present invention relates to a programmable boat lift control system. The present invention includes the following interrelated objects, aspects and features:

(A) In the preferred embodiment of the present invention, the boat lifting mechanism itself consists of two parallel motor driven tubes constrained to rotate together, each rotating tube having a first end of a cable attached thereto with a second end of each cable attached to a horizontal I-beam. The first end of the cable is wrapped about the tube with a pulley interposed between the second end and the wrappings. The pulley is attached to a frame designed to support a boat.

(B) When the tubes are synchronously rotated, each cable is wrapped about each respective tube while the second end or fixed end is maintained in a stationary position. Each cable is attached at its fixed end to the I-beam at one location, the weight of the frame holding the attachment point at a lower position. As the tubes are turned to either lift or lower the frame, each cable passes under its rotating pulley and along its tube to equalize the lengths of cable extending to either side thereof and up to the tube.

(C) Each tube has, associated therewith, a limit stop mechanism preventing the frame from being lifted and lowered beyond pre-set limits. Each limit stop mechanism includes, in the preferred embodiment, a magnetic sensor that remains closed in the presence of a magnetic actuator. The magnetically actuator is normally in alignment with the sensor to maintain the circuit closed and the lift operable. However, each of the limit stop mechanisms is positioned, with respect to a cable, so that when the cable is lifted or lowered beyond the pre-set limits, the actuator is dislodged from alignment with the sensor to cause opening of the circuit and disabling of the system. In the preferred embodiment, each limit stop mechanism includes a separate actuator for each of the upper limit stop and the lower limit stop.

(D) In a further aspect, the inventive system may be operated manually through selective depression of buttons labelled "up" and "down", respectively. In the manual mode, the frame will move in the direction requested so long as the corresponding button is maintained depressed until the button is released or a limit stop mechanism is activated where the frame is moved beyond the pre-set limits.

(E) As disclosed, the system may also operate in an automatic mode either by pushing buttons at the location of the lift or through remote control means. In either mode, the system is pre-programmed to cause the frame to be lifted or lowered and to automatically stop at pre-set elevations which may correspond to such conditions as low or high tide as well as particular desired elevations such as an elevation for loading and unloading passengers and/or cargo, and a further higher elevation for storage. The particular manner of programming and operation, in this regard, will be explained in greater detail hereinafter.

As such, it is a first object of the present invention to provide a programmable boat lift control system.

It is a further object of the present invention to provide such a system which may be operated automatically to move up or down and stop at pre-set elevations.

It is a yet further object of the present invention to provide such a system which may be pre-programmed for the desired stopping elevations in an easy and reproducible manner.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
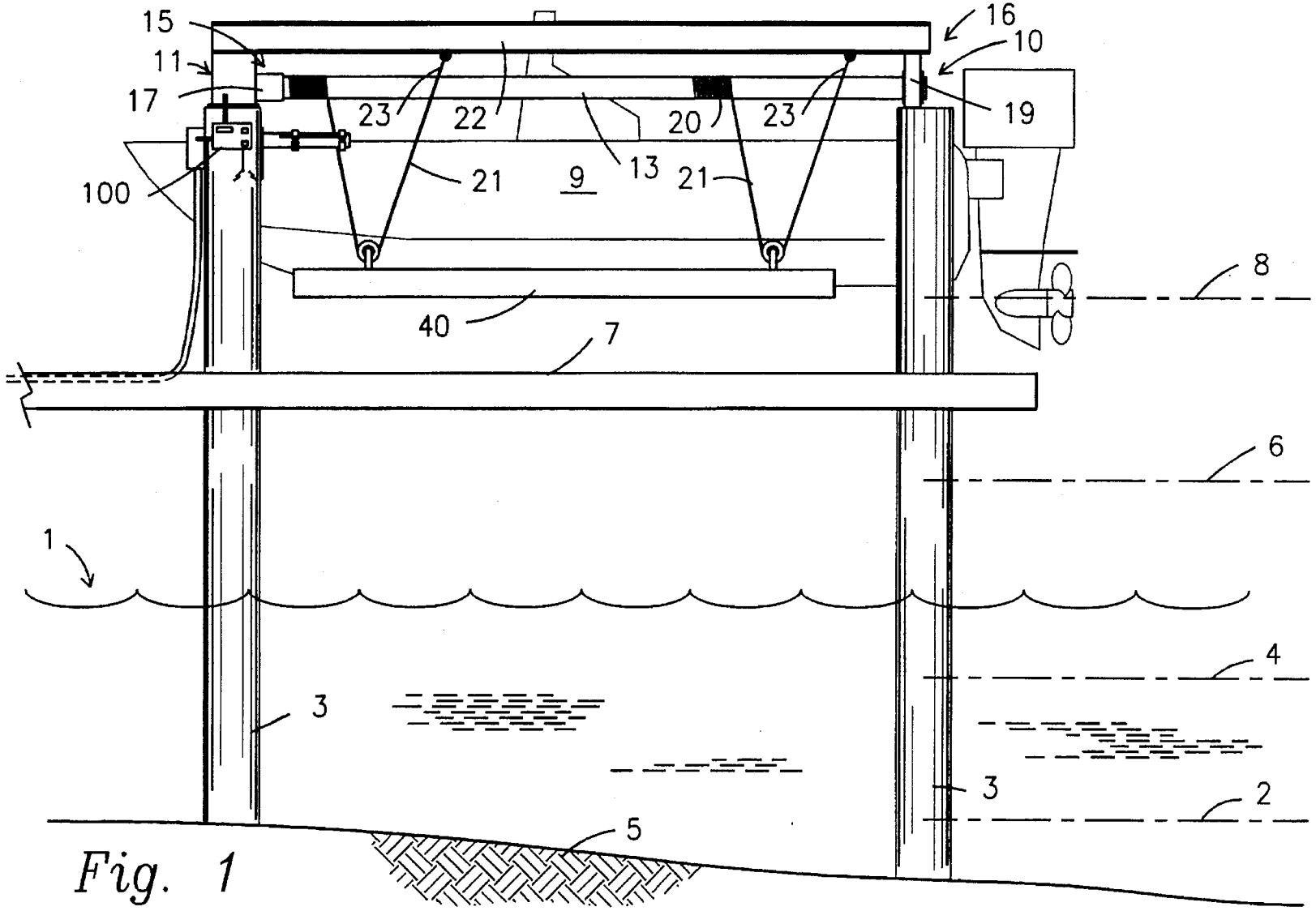
FIG. 1 shows a side elevational view of the present invention with the frame thereof elevated to a storage position.

With reference, first, to FIGS. 1–4, a body of water 1 has pilings 3 driven through the bed 5 thereof with a pier 7 located adjacent the pilings 3 and supported by further pilings (not shown). As should be understood by those skilled in the art, the inventive boat lift system 10 is preferably supported on four pilings 3, with only two such pilings being shown as representative of the inventive system. As will be explained in greater detail hereinafter, as is the case with most boat lifts, a pair of matched synchronously operated lifting mechanisms is employed of which only one is illustrated herein, it being understood that the lifting mechanism which is not shown operates in the same manner as that which is shown in the drawings and explained herein.

The inventive system is generally designated by the reference numeral 10 and includes lifting and lowering means including a pair of motors 11 of which one is shown in the figures, each of which rotates an elongated tube 13 which is supported at one end 16 thereof by the motor drive shaft 17 and at the other end by a bearing 19 supported on one of the pilings 3. The motor 11 is supported on another one of the pilings 3.

Figure 3:
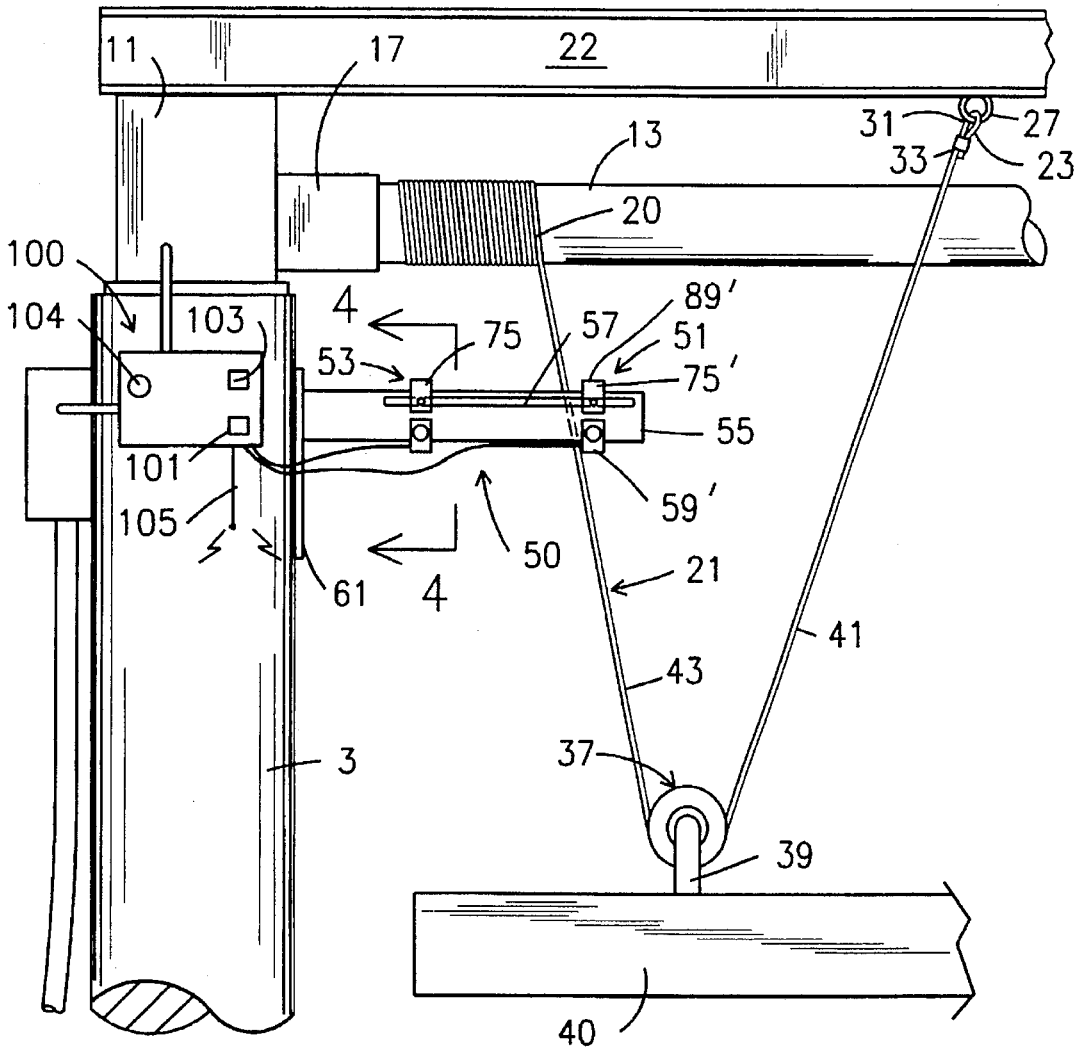
FIG. 3 shows an enlarged side elevational view of a portion of the present invention in an orientation corresponding to that of FIG. 1.

With particular reference to FIG. 3, it is seen that a cable 21 is wrapped at a first end 20 around tube 13. At a second end 23 the cable 21 is fixedly attached to I-beam 22 via a ring 27 which is suspended from I-beam 22. Band 33 holds end 23 of cable 21 in a fixed position.

The ultimate first end of the cable 21 is attached to the periphery of the tube 13 in a manner well known to those skilled in the art and, as the tube 13 is rotated by the motor 11, either wraps itself about the periphery of the tube 13 or, as the case may be, unwraps itself. A plurality of revolutions of wrapping of the cable 21 about the tube 13 are shown in FIG. 3. Between the first end 20 of the cable 21 and the second end 23 thereof, the cable 21 extends under a pulley 37 supported on a device encompassing the frame 40 by a bracket 39. The supporting device can be multiple cables attached directly to the boat as is well known in the prior art. The pulley 37 freely rotates on bearings (not shown).

Figure 2:
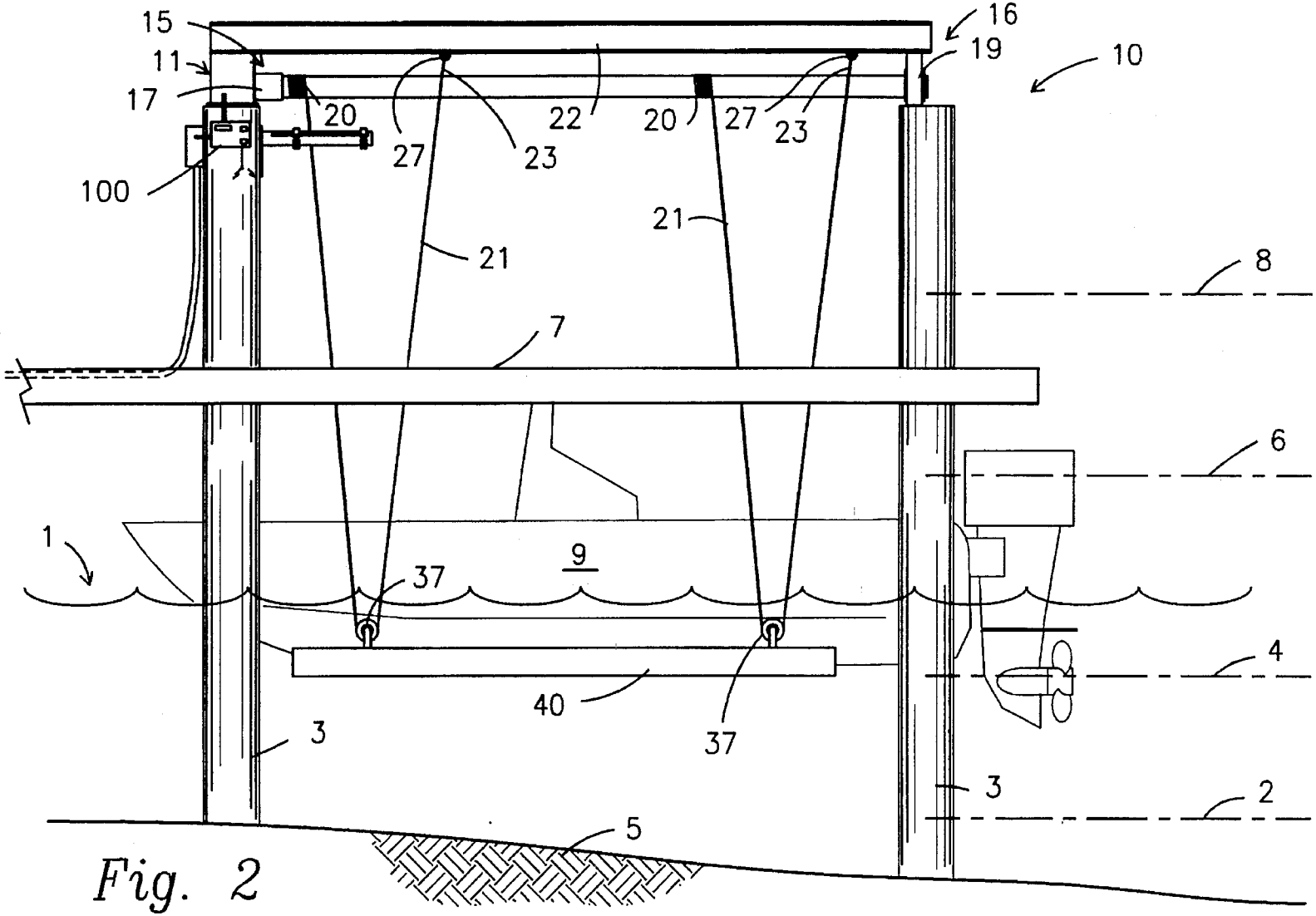
FIG. 2 shows a further side elevational view of the present invention with the frame thereof shown lowered to a position corresponding to high tide.

As should be understood from FIGS. 1, 2 and 3, the cable 21 forms a first leg 41 between the ring 27 and the pulley 37 and a second leg 43 between the pulley 37 and the tube 13. As should be understood with particular comparison of FIGS. 1 and 2, the legs 41 and 43 maintain substantially equal lengths to form, along with a portion of the tube 13 extending therebetween, an isosceles triangle. As the tube 13 is rotated to unwind the cable 21 therefrom, the legs 41 and 43 lengthen. As should be understood with particular reference to FIG. 3, as the tube 13 is rotated to wrap the cable 21 thereabout, the position of the leg 43 of the cable 21 moves toward the right-hand direction in the view of FIG. 3. Conversely, when the tube 13 is rotated in the opposite direction to unwind the cable 21 therefrom, the location of the leg 43 of the cable 21 moves in the left-hand direction in the view of FIG. 3. In this connection, the present invention includes limit stop means comprising a limit stop mechanism 50 designed to take advantage of this lateral movement of the position of the leg 43 of the cable 21.

Figure 4:
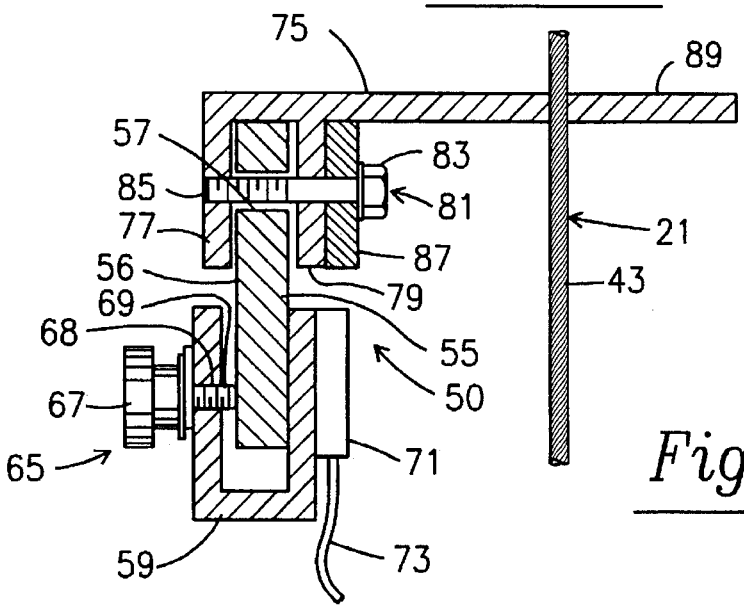
FIG. 4 shows a cross-sectional view along the line 4—4 of FIG. 3.

With particular reference to FIGS. 3 and 4, the limit stop mechanism 50 includes a first limit stop 51 designed to be activated at a pre-set high elevation of the frame 40, and a second limit stop 53 designed to be activated at a pre-set lower elevation of the frame 40. FIG. 4 shows the second limit stop 53 and is representative of the first limit stop 51, as well. With reference to FIGS. 3 and 4, an elongated bar 55 extends outwardly from the piling 3 in generally parallel relation to the tube 13. The bar 55 has an elongated slot 57 therein for a purpose to be described in greater detail hereinafter. The bar 55 is attached to the piling 3 through the use of a bracket 61. Any suitable means may be used to attach the bracket 61 to the piling 3 including bolts or nails or any other type of fastener.

A bracket 59 is attached to the bottom of the bar 55 through the use of a set screw 65 having a head 67 to which is attached a threaded rod 69 threadably received through a threaded hole 68, through the bracket 59. The end of the rod 69 bears against a side wall 56 of the bar 55 to hold the position of the bracket 59 at any desired location along the length of the bar 55. A sensor 71 is fastened to the bracket 59 by any suitable means such as, for example, adhesive, bolts, or the like, and includes an electrical conductor 73 extending therefrom to control means as will be described in greater detail hereinafter. The sensor 71 is of the type which remains in a closed condition when exposed, within a pre-set range and orientation, to the actuator 87. In this connection, when the actuator 87 is not within the pre-set range and orientation, the sensor 71 opens thereby disabling the associated circuit.

A further bracket 75 is mounted on the bar 55 and includes downwardly depending legs 77 and 79 and is attached to the bar 55 through the use of a through bolt 81 having a head 83 and a threaded rod 85 extending through the slot 57 and threadably received within a threaded opening in the leg 79 of the bracket 75. The bolt 81 captures the actuator 87 which, in the position shown in FIGS. 3 and 4, is in the position and orientation causing the sensor 71 to be maintained in a closed configuration.

As should be understood by those skilled in the art from FIGS. 3 and 4, the bracket 59 may be located at any position on the bar 55 by loosening the set screw 65, sliding the bracket 59 to the desired location and then tightening the set screw 65 to lock the position thereof. The position of the bracket 59 is slid in the left and right-hand directions in the view of FIG. 3 to set the elevation of the frame 40 at which the cable 21 will trip the mechanism 53. For this purpose, the bracket 75 has a leg 89 extending in the right-hand direction in the view of FIG. 4 and into the paper in the view of FIG. 3. With the position of the bracket 59 set as desired as shown in FIGS. 3 and 4, the bracket 75 is moved to a position aligning the actuator 87 with the sensor 71 so that the sensor 71 is in the closed position thereof. As explained above, as the tube 13 is turned by the motor 11 to unwind the cable 21 therefrom, the leg 43 of the cable 21 moves in the left-hand direction in the view of FIG. 3. Thus, the limit stop 53 is particularly designed to control the lowermost desired level of the frame 40 since continuing unwinding of the cable 21 in the view of FIG. 3 will move the leg 43 thereof in the left-hand direction until such time as the cable 21 engages the leg 89 of the bracket 75, as should be understood from the view of FIG. 4, with further unwinding of the cable 21 causing the leg 43 thereof to continually engage the leg 89 of the bracket 75 and thereafter move it in the left-hand direction of FIG. 3 to misalign the actuator 87 from the sensor 71 thereby causing the circuit to open.

In a corresponding way, the limit switch 51 has a lower bracket 59' and an upper bracket 75' which includes a leg 89' (not shown in detail in the figures). As should be understood from the above description, when the tube 13 is rotated by the motor 11 to wind the cable 21 thereon, after a particular number of turns of the cable 21 is wound upon the tube 13, the leg 43 thereof will have moved sufficiently in the right-hand direction in the view of FIG. 3 to engage the leg 89' of the bracket 75', with further winding of the cable 21 onto the tube 13 causing the bracket 75' to be moved in the right-hand direction in the view of FIG. 3 to misalign the actuator (not shown) attached to the bracket 75' from its prior position of alignment with the sensor (not shown) attached to the bracket 59' to thereby cause the circuit to be opened. The position of the bracket 59' may be adjusted in the same manner as is the case with the bracket 59.

As should be understood from FIG. 3, the position of the bracket 59 must be set so that there is sufficient amount of the slot 57 leftward thereof in the view of FIG. 3 to permit misalignment of the bracket 75 with the bracket 59 in the left-hand direction. Correspondingly, the bracket 59' must be so positioned on the bar 55 so that there is sufficient amount of the slot 57 to the right of the bracket 59' in the view of FIG. 3 to permit the bracket 75' to be misaligned in the right-hand direction in the view of FIG. 3.

As should be understood from the above description, the operation of the lifting mechanism for the other pair of pilings 3 (not shown) is identical to that which has been described hereinabove for those aspects which are illustrated in the figures.

The inventive system is operated by a control or controller 110 located within box 100 shown in FIGS. 1–3. The controller 110 may be operated by button means through pushing of buttons 101 and 103 best seen in FIG. 3 or through the use of a remote controller having a wireless transmitter sending signals to be received by the antenna 105 of a receiver 250 located within box 100.

Figure 5:
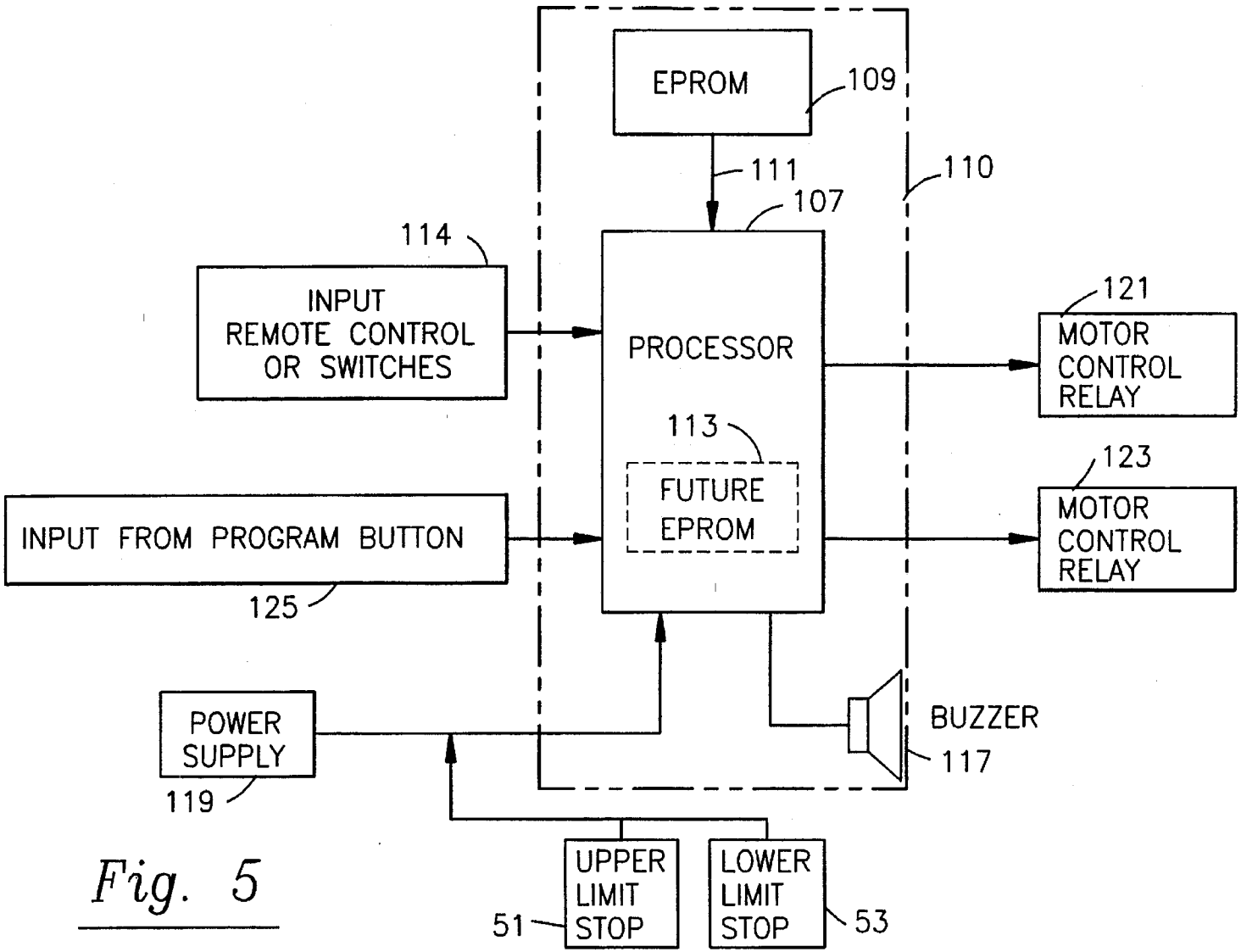
FIG. 5 shows a schematic representation of the electrical circuitry of the present invention.

With reference to FIG. 5, a schematic representation of the electrical circuitry of the present invention is shown. The controller 110 is depicted by the dotted line enclosure of FIG. 5 and includes a processor 107, programmable means comprising an EPROM 109 which may, if desired, be a separate chip which may be selectively coupled to the processor 107 as depicted by the reference numeral 111. If desired, the processor 107 may include a built-in EPROM designated in phantom by the reference numeral 113. Also included in the controller 110 is an input section 114 which receives signals either from a switch located on the box 100 (FIG. 3) or from switches on a remote control unit (not shown) which are sent via wireless transmission. The controller 110 also includes an indicator 117 which is shown in FIG. 5 to be a buzzer. Of course, the indicator 117 may include a buzzer, other sounding device, illumination means or any combination thereof. A power supply 119, preferably a transformer, supplies power to the controller 110.

The controller 110 controls relays 121 and 123 with the relay 121 controlling the motors 11 in an up direction and with the relay 123 synchronously controlling the motors in a down direction.

The box 125 is representative of receipt of programming signals from a program button 104 (FIG. 3) in a manner to be described in greater detail hereinafter. Furthermore, as also seen in FIG. 5, the inventive system includes a manual override using the input from the program button 104 allowing the system to be operated manually through the use of a dual switch 101 and 103. As also shown in FIG. 5, the upper limit stop 51 and the lower limit stop 53 are incorporated into the manual override sub-system to disarm the power supply 119.

Figure 7:
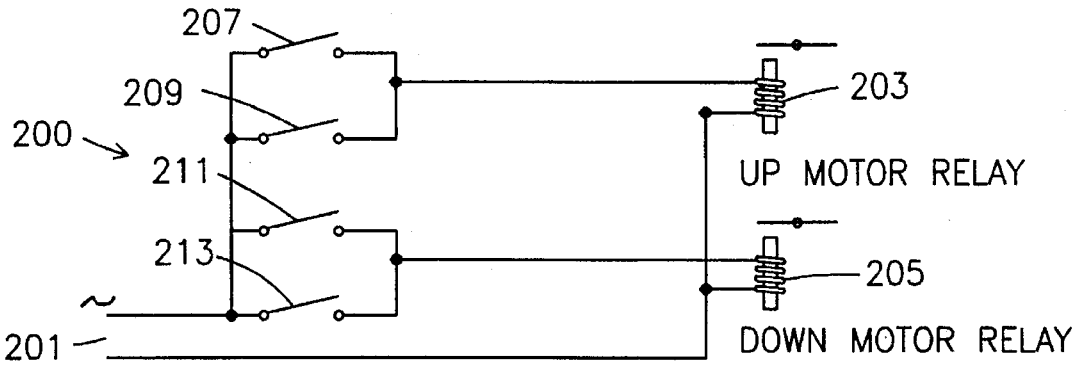
Fig. 7 PRIOR ART
FIG. 7 shows a schematic representation of a prior art electrical circuit for operating a boat lift.

FIG. 7 depicts a prior art boat lift control circuit 200 which includes a source of AC voltage 201, an up motor relay 203, a down motor relay 205 and switches 207, 209, 211 and 213.

Either of the switches 207 or 209 may be closed to activate the up motor relay 203. The switch 207 is a manual switch located adjacent the system whereas the switch 209 is a remote control switch operable in a manner well known to those skilled in the art. Similarly, either of the switches 211 or 213 may be closed to operate the down motor relay 205. The switch 211 is a manual switch located adjacent the system while the switch 213 is a remote switch operable remotely through some communication such as, for example, wireless transmission.

Figure 8:
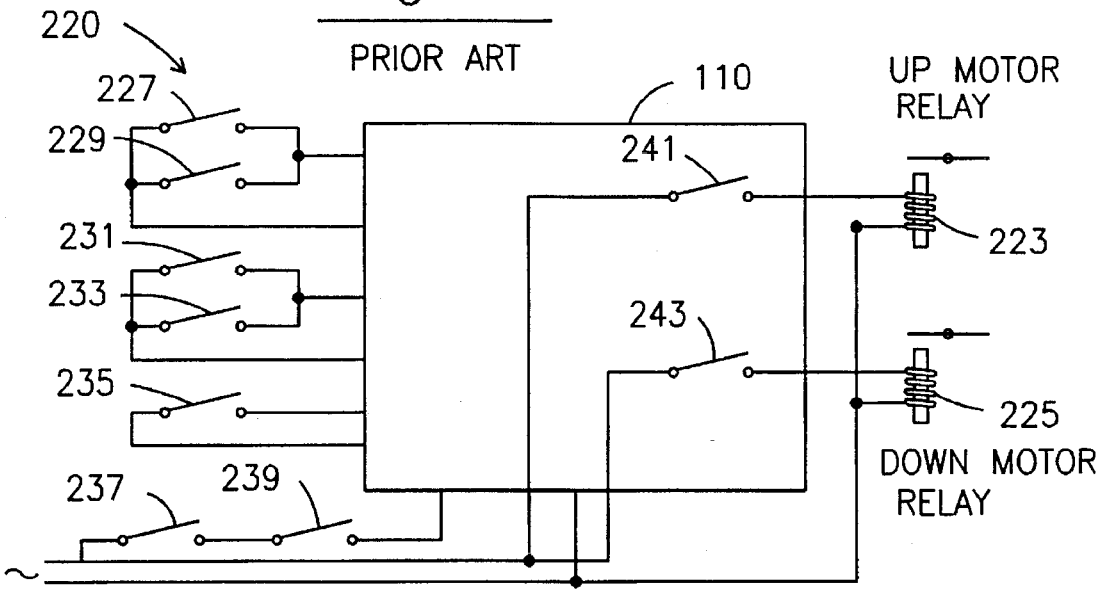
FIG. 8 shows a schematic representation of one aspect of the electrical circuitry of the present invention concerning automatic operation.

With reference to FIG. 8, the present invention includes a circuit 220 allowing automatic operation either remotely or manually which includes a schematic representation of a circuit board of the controller 221 which may be plugged into the system as well as an up motor relay 223 and a down motor relay 225. Switches 227, 229, 231, 233, 235, 237, 239, 241 and 243 are provided for reasons which will be explained hereinbelow.

Thus, either of the switches 227 or 229 may be closed to operate the up motor relay 223 via the controller 110, with the switch 227 comprising a manual switch located on box 100 and adjacent the controller 110 and with the switch 229 being representative of a remote control receiver 250 connected to the controller 110' via wireless transmission. Similarly, either of the switches 231 or 233 may be closed to operate the down motor relay via the controller 110, with the switch 231 comprising a manual switch adjacent the controller 110 and with the switch 233 being representative of a remote control receiver connectable with the controller 110 via wireless transmission.

The switches 237 or 239 comprise limit switches with the switch 237 corresponding to the lower limit stop 53 (FIG. 3) and with the switch 239 corresponding to the upper limit stop 51 (FIG. 3).

Figure 9:
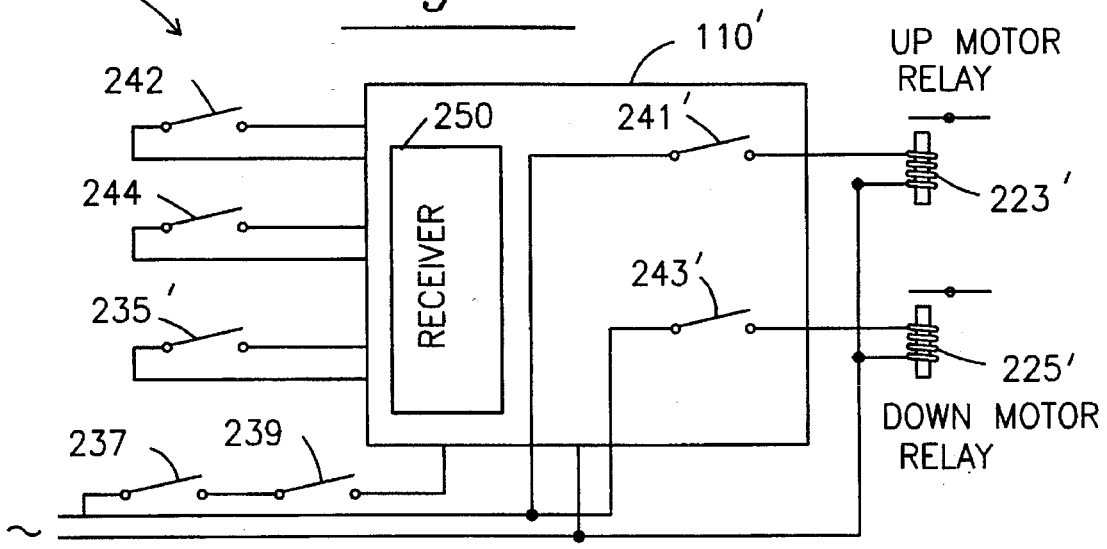
FIG. 9 shows a schematic representation of another aspect of the electrical circuitry of the present invention employed when a receiver is added to the circuitry.

With reference to FIG. 9, which shows the circuitry employed when the remote receiver 250 is employed, like elements are referred to using like primed reference numerals. Thus, the system 240 includes manual up and down switches 242, 244, respectively, and programming switch 235' as well as the limit switches 237' and 239' and the relay control switches 241' and 243'. The relays 223' and 225' are also shown. A receiver 250 is shown in the schematic representation of a circuit board of the controller 110'.

Figure 6:
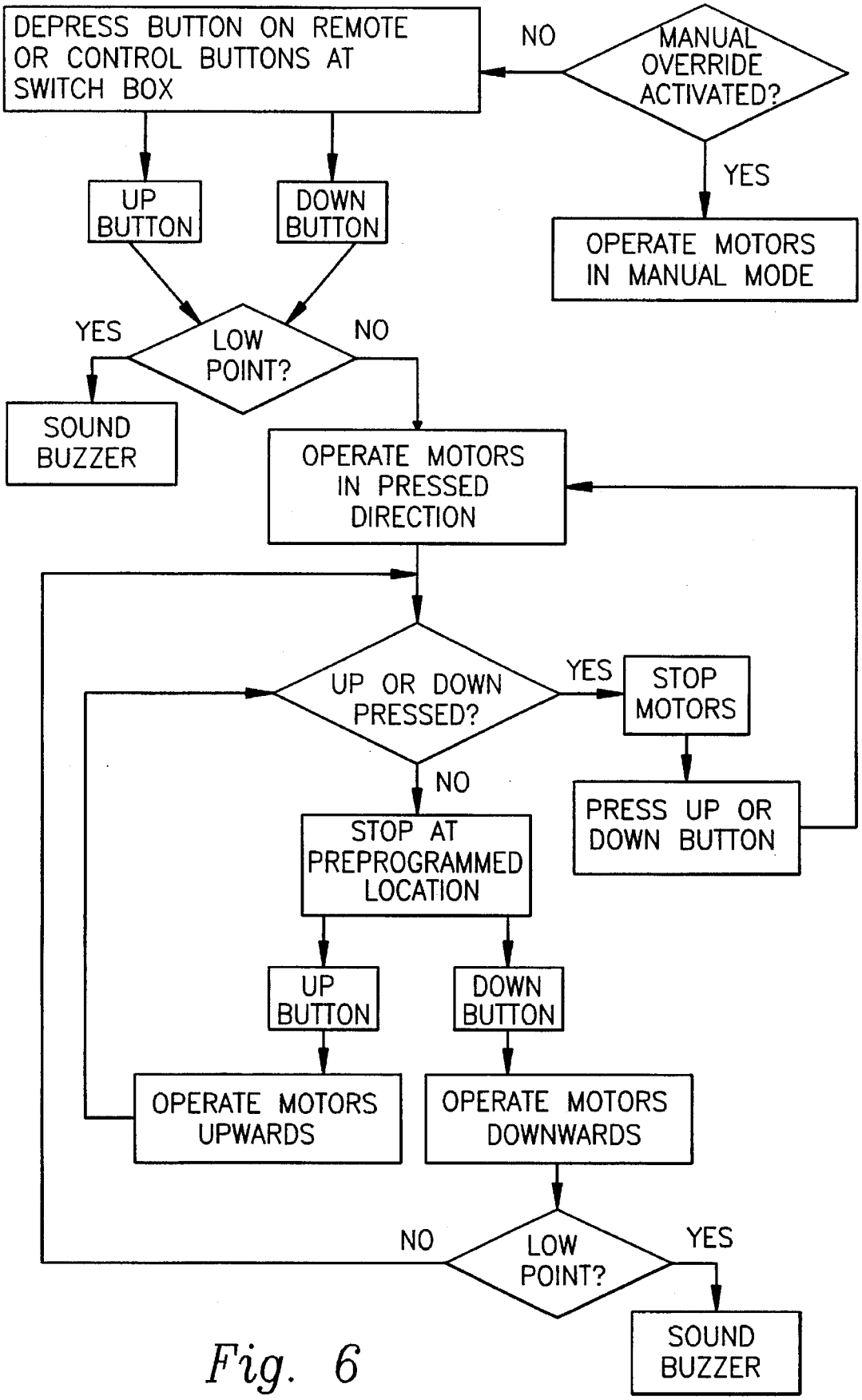
FIG. 6 shows a flow chart of the intended mode of operation of the present invention.

With reference, now, to FIG. 6, an explanation will be made of the logic of the operation of the inventive system. In such mode, as explained in FIG. 6, when the up button is pressed, if the system is at the upper limit of the frame 40, the buzzer 117 is sounded and the boat lift will not operate. If not, the motors are operated to raise the frame 40 toward the pre-programmed level. As further explained in FIG. 6, if the up or down buttons are pressed during this operation, operation is stopped until further instructions are given. If not, operation continues and the frame 40 continues to be raised until it is stopped at the pre-programmed level. The explanation of operation when the down button is pressed corresponds thereto.

In the preferred embodiment of the present invention, a programming sequence may be undertaken to pre-program operation of the inventive system so that the frame 40 may be raised or lowered and may be stopped at desired pre-set levels such as the levels 2, 4, 6 and 8, particularly illustrated in FIG. 1.

First, indication is given to the controller 110 by suitable means (not shown) that the program mode thereof is being entered. The controller 110 will beep every five seconds to designate program mode. A button 101 or 103 is operated to position the frame 40 to a first desired elevation, for example, a low tide elevation. When that elevation has been achieved, to store that position in the memory of the controller, the program button 104 associated with the box 125 shown in FIG. 5 is pressed two times. When the button is pressed twice, the processor 107 operates the buzzer to buzz twice to indicate that the data has been received and stored. Then, a button 101 is operated to move the frame 40 to the next desired memory position, for example, a high tide elevation. To store this position in the memory, the program button 104 associated with the box 125 in FIG. 5 is pushed three times. When the button is pressed three times, the processor 107 operates the buzzer to buzz three times to indicate that the data has been received and stored. Thereafter, a button 101 is pushed to move the frame 40 to the next desired programmed position, for example, a loading and unloading elevation, whereupon the 104 button associated with the box 125 in FIG. 5 is pressed four times. When the button is pressed four times, the processor 107 operates the buzzer to buzz four times to indicate that the data has been received and stored. Thereafter, a button 101 is pushed again to elevate the frame 40 to the next programmed position, for example, a storage position, whereupon the program button 104 associated with the box 125 in FIG. 5 is pressed five times. When the button is pressed five times, the processor 107 operates the buzzer to buzz five times to indicate that the data has been received and stored. Thereafter, button 104 is pushed indicating to the controller 110 that the user has exited the program mode. If desired, a keypad (not shown) may be provided with the controller 110 to allow inputting of code sequences to allow entry and exit from the programming mode to prevent tampering with the system.

With the system so programmed, wherever the frame 40 is located, when the up button 101 is pushed and released, the controller 110 will operate to move the frame 40 to the next higher pre-programmed elevation. Of course, if, when the up button 101 is pushed, the frame 40 is already at the highest elevation, instead, the processor 107 will cause the buzzer 117 to be activated and stop the lift. Similarly, if the down button 103 is pushed and released, and the frame 40 is already in the lowermost position thereof, the processor 107 will cause the buzzer 117 to activate and stop the lift. Otherwise, such activation of the down button 103 will cause the controller 110 to operate the system to move the frame 40 to the next lower pre-programmed elevation.

As explained hereinabove, and shown in FIG. 5, the limit stops 51 and 53 protect the system in case a malfunction causes the motors 11 to continue to operate beyond the pre-programmed elevations. In this way, the limit stops 51 and 53 may operate to shut the system down if the frame 40 is moved past the pre-set limit stop upper and lower limitations. Of course, the upper and lower limit stops 51 and 53 are incorporated into the manual override aspect of the system to prevent damage to the system that would occur by moving the frame 40 to upper and lower levels beyond appropriate limits.

When the controller 110 is being operated, timer means comprising an internal timing mechanism keeps track of the amount of time that the motors 11 have synchronously operated to determine when the motor relays 121, 123 are deactivated indicative of the desired level of the frame 40 having been reached. Thus, for example, when the system is being programmed, the processor 107 stores information indicative of the amount of time the motors 11 must operate between the various pre-programmed levels, for example, 2 and 4, 4 and 6, 6 and 8, respectively. In this way, accurate reproducible operation of the motors 11 may be accomplished.

If desired, an additional programmable system may be provided to allow control of the elevation of the frame 40. In this regard, vertically spaced height adjustable moisture sensors may be provided along one of the pilings 3. For example, a multiplicity of such sensors may be located in an elevation range between an expected low tide elevation and an expected high tide elevation. These moisture responsive sensors may be interconnected with the processor 107 in a manner which should be understood by those skilled in the art in such a way that the processor 107 will have continuing knowledge of the particular elevation of the body of water where the inventive system 10 is located. In this way, the controller 110 may be suitably programmed in a manner which should be understood by those skilled in the art so that when a boat 9 is on the frame 40 and it is desired to lower the boat into the body of water 1, based upon the number of moisture responsive sensors which have been closed through immersion in the body of water, the processor 107 may suitably control the motor control relays 121 and 123 to lower the frame 40 to a position where the boat 9 is precisely at the level of the body of water. Such a system may easily be incorporated into the teachings of the present invention.

As such, an invention has been disclosed in terms of a preferred embodiment thereof with suitable modifications and variations which fulfills each and every object, aspect and feature of the present invention and provides a new and useful programmable boat lift control system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. In a boat lifting system including a device for supporting a boat, lifting and lowering means for listing and lowering said device including a motor and a control therefor, the improvement comprising:

(a) button means for inputting "up" and "down" commands to said control;

(b) said control including programmable means for programmably controlling operation of said motor responsive to signals received from said button means to lift or lower said device a preselected distance to a preselected elevation and causing said motor to deactivate when said device arrives at said preselected elevation; and (c) said control further including timer means for timing duration of motor operation, said timer means providing timer signals indicative of a time period of motor operation to said programmable means whereby said preselected elevation may be set through deactivation of said motor when said time period has elapsed.

2. The system of claim 1, wherein said button means is physically adjacent said control.

3. The system of claim 1, wherein said button means is on a remote control device which may transmit wireless signals to be received by said control.

4. The system of claim 1, wherein said preselected elevation comprises a plurality of discrete preselected elevations.

5. The system of claim 4, wherein said preselected elevations correspond to low tide, high tide, a loading and unloading elevation and a storage elevation.

6. The system of claim 1, wherein said system includes a manual override sub-system including a manual override code which, when entered, bypasses said control, and manual "up" and "down" switches for manually controlling motion of said device.

7. The system of claim 1, further including limit stop means for disabling said motor when said device is raised to a pre-set elevation.

8. The system of claim 1, further including limit stop means for disabling said motor when said device is lowered to a pre-set elevation.

9. The system of claim 1, further including limit stop means for disabling said motor when said device arrives at a pre-set elevation.

10. The system of claim 9, wherein said limit stop means comprises a magnetic sensor engageable by a portion of said lifting and lowering means to disable said motor.

11. The system of claim 10, wherein said portion comprises a cable.

12. The system of claim 9, wherein said limit stop means comprises a first limit stop setting an upper elevation limit and a second limit stop setting a lower elevation limit.

13. A method of programming a boat lift system to lift a boat supporting frame to pre-settable elevations, said system including a frame lifting motor, a timer and programmable means for programmably controlling said motor, said method including the steps of:

(a) activating said motor to move said frame a desired distance from a known starting elevation;

(b) deactivating said motor when said desired distance has been achieved;

(c) inputting data into a control as to said desired distance; and d) timing a duration of operation of said motor to move said desired distance.

14. The method of claim 13, wherein said desired distance comprises a first distance, said method further including the step of re-activating said motor to move said frame a second distance while timing duration of operation of said motor to move said second distance, deactivating said motor when said second distance has been achieved, and inputting data into said control as to said second distance.

15. A programmable boat lift control system incorporated into a manual motor driven boat lift apparatus mounted on multiple pilings, the boat lift control system comprising:

(a) a controller mounted on the boat lift apparatus;

(b) pre-programmed information stored in the controller adapted to control movement of the boat lift apparatus to multiple vertical levels;

(c) timer means within the controller to keep track of an amount of time, the motor operates between the various pre-progammed levels so that in response to inputting a command to the controller the boat lift apparatus will move to the required pre-programmed level.

16. The boat lift control system according to claim 15 wherein the pre-programmed levels are storage, loading, high tide and low tide.

17. The boat lift control system according to claim 15 wherein the controller has an exterior button adapted to be pressed in a predetermined sequence to input the pre-programmed multiple vertical levels for the boat lift apparatus.

18. The boat lift control system according to claim 15 wherein upper and lower limit stops are electrically connected to a power supply so that the motor is deactivated if the boat lift apparatus exceeds its upper or lower limit of vertical travel.

* * * * *